United States Patent [19]

Bulten

[11] Patent Number: 4,887,854

[45] Date of Patent: Dec. 19, 1989

[54] GATE SUPPORT LATCH

[75] Inventor: Paul J. Bulten, Tulsa, Okla.

[73] Assignee: Fence Hardware Specialties, Inc., Tulsa, Okla.

[21] Appl. No.: 183,070

[22] Filed: Apr. 19, 1988

[51] Int. Cl.[4] ..... E05C 3/14

[52] U.S. Cl. ..... 272/238; 292/205; 292/104; 292/245

[58] Field of Search ..... 292/238, 231, 230, 198, 292/205, 207, 136, 120, 218, 244, 245, DIG. 12, DIG. 30, DIG. 13, 213, 215, 104

[56] References Cited

U.S. PATENT DOCUMENTS

| | | | |
|---|---|---|---|
| 32,990 | 8/1861 | Ellis | 292/230 |
| 811,880 | 2/1906 | Steensland et al. | 292/136 |
| 996,792 | 7/1911 | Peterson | 292/136 |
| 1,312,051 | 8/1919 | Ross | 292/198 |
| 1,504,544 | 8/1924 | Kintner | 292/238 |
| 1,647,484 | 11/1927 | Swanson . | |
| 1,812,334 | 6/1931 | Gloekler | 292/205 |
| 1,922,455 | 8/1933 | Quigley | 292/340 |
| 2,334,426 | 11/1943 | McCulloch | 292/238 |
| 3,265,425 | 8/1966 | Berger | 292/238 |
| 3,433,518 | 3/1969 | Foltz | 292/238 |
| 3,492,036 | 1/1970 | Young | 292/244 |
| 3,907,344 | 9/1975 | Newlon et al. | 292/66 |
| 4,305,611 | 12/1981 | Robins | 292/238 |
| 4,427,223 | 1/1984 | Godec et al. | 292/92 |
| 4,690,440 | 9/1987 | Rogers | 292/54 |

FOREIGN PATENT DOCUMENTS

| | | | |
|---|---|---|---|
| 10047 | of 1892 | United Kingdom | 292/238 |
| 9063 | of 1896 | United Kingdom | 292/238 |

*Primary Examiner*—Gary L. Smith
*Assistant Examiner*—Eric Nicholson
*Attorney, Agent, or Firm*—Head & Johnson

[57] ABSTRACT

A gate latch structure is provided for use with either right-handed or left-handed gates. The latch includes a symmetrical main frame and keeper. The main frame has a striker receiving opening with two opposite cam surfaces flaring outwardly into a "Vee". A retainer stub is fixed to the main frame at a mid location at the inner end of the opening. A substantially flat keeper having a longitudinal axis has two opposite symmetrical striker receiving notches positioned at one end. The other end is pivotally connected at only one point to the main frame. The keeper may be sprung over the stub. While on one side of the retainer stub the keeper is for right handed gate and when it is on the other side it is for a left-handed gate. There are no springs and the weight of the keeper bar causes it to close over the striker.

10 Claims, 3 Drawing Sheets

GATE SUPPORT LATCH

BACKGROUND OF THE INVENTION

This invention relates generally to gate latches and more particularly concerns a latch structure which can be used on either a right hand or a left hand hung gate.

Latching mechanisms for gates are among the oldest and most widely used mechanical devices. The search is continuing for effective low cost latching devices which can be used in a wide variety of applications. Many existing gate latches are constructed in such a manner that the striker bar impacts on the back side of the striker bar opening a pivotal latch member as the gate latch is closed. this imposes great impact shock loads on the pivotal latch member itself and on the pivot screw mounted to the pivot latch member. With repeated cycles of this impact shock loading the mounting of the pivot latch member tends to become loosened.

There have been efforts to develop gate latches for either a left hand or a right hand gate. All of these, of which applicant is aware, require some dismantling, that is removing screws or bolts and shifting parts and reinstalling the bolts or screws.

Therefore, it is an object of this invention to provide a gate latch which can be used on either a left hand or right hand gate without any disassembly.

It is another object of this invention to provide a latch structure which operates without springs.

It is a still further object of this invention to provide a latch assembly in which the latch has a keeper is protected by the main frame and in which the gate can be opened from the inside or outside.

SUMMARY OF THE INVENTION

This is a gate latch structure for receiving a striker bar. The gate latch structure is mounted on a post and the striker bar on the gate. The latch structure includes a mostly flat main frame having a striker receiving opening or notch and two opposite cam surfaces flaring outwardly from the opening. A retainer stub is fixed to the main frame at the inner or base end of the notch. An elongated substantially flat keeper which is symmetrical about a longitudinal axis is provided. At the head end there are two striker receiving lock notches which are symmetrically placed on either side of the keeper as a part of its outer edge. These lock notches are designed and positioned such that they will fit over the striker bar when it is in the striker receiving opening or notch of the main frame. The other end of the keeper is pivoted to the main frame. The head of the keeper is shaped somewhat like an isosceles triangle with a rounded end. When the striker comes toward the gate latch structure it will be guided by one of the cams of the main frame and will work against one of the sides of the head of the keeper to force it up so that the striker may enter the opening. Once the striker has entered the lock notch of the main frame, the weight of the keeper will let the keeper fall down so that the striker is locked within the lock notch of the keeper. When it is desired to open the gate all that is necessary to do is to lift up on either the head of the keeper if one is on one side of the gate and if you are on the other side of the gate is to push down on the end adjacent the pivot.

There are also locking means to lock the keeper to the main frame when it is in the striker bar holding position.

One can use the latch structure of this invention on either a left hand or right hand gate. The retaining stub on the main frame keeps the keeper on one side or the other of the stub so that it can be used to get the correct action so that gravity will close the keeper. If it is desired to use it on an opposite type gate all that is necessary to do is to lift up on the head of the keeper and lift the keeper over the retaining stub of the main frame so that the keeper is on the opposite side of the stub from what it was and then it can be used on the opposite handed gate. This is permitted because there is only one pivot point and the spring of the keeper permits it to. However once installed the keeper will stay on whatever side of the retaining stub that it was installed.

DETAILED DESCRIPTION

Figure 1:
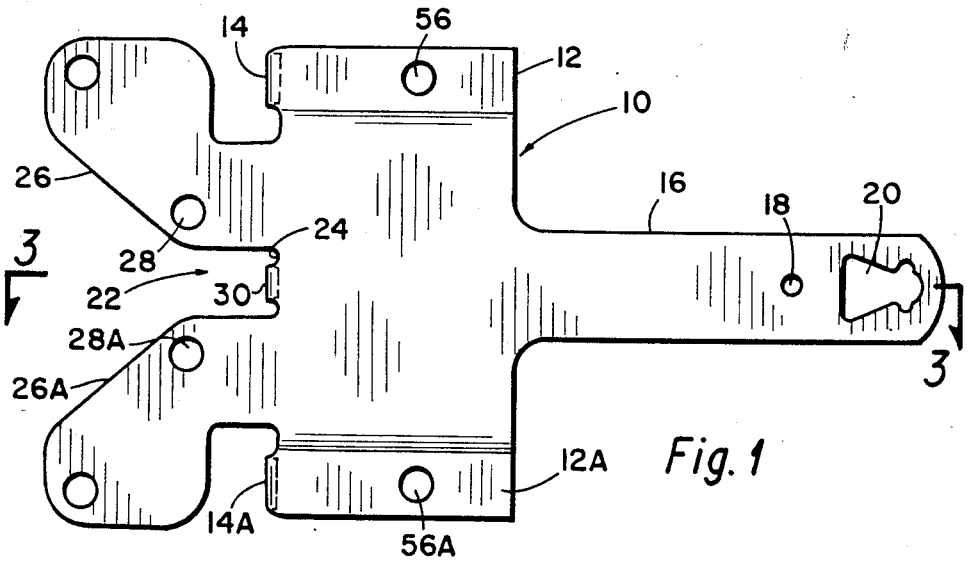
FIG. 1 is a full face view of the main frame of the latch.

Attention is first directed to FIG. 1 which shows the latch main frame 10. As one can see this main frame is symmetrical about an axis running along the section line 3—3. The main frame 10 is substantially flat and has a raised spacer 12 with alignment stub 14 on one side and a second raised spacer 12A and alignment stub 14A which are symmetrical to spacers 12 and alignment stub 14. The main frame has a rear extension 16 which has a pivot hole 18 and a padlock or locking hole 20. In the main frame 10 on the opposite end from the padlock hole 20 there is provided a striker receiving opening or notch 22 which has an inner end 24. Flaring outwardly from opening 22 is an upper entrance cam surface 26 and a lower entrance cam surface 26A which is symmetrical to the upper entrance cam surface. These cam surfaces typically may make an angle of about forty-five degrees with the longitudinal axis, previously defined. An upper padlock hole 28 and a lower symmetrically placed padlock hole 28A are provided in the main frame 10 adjacent the striker receiving notch 22. A keeper retaining stub 30 is provided at the rear end of the notch 22. This stub may be about three-eighths of an inch in height.

Figure 2:
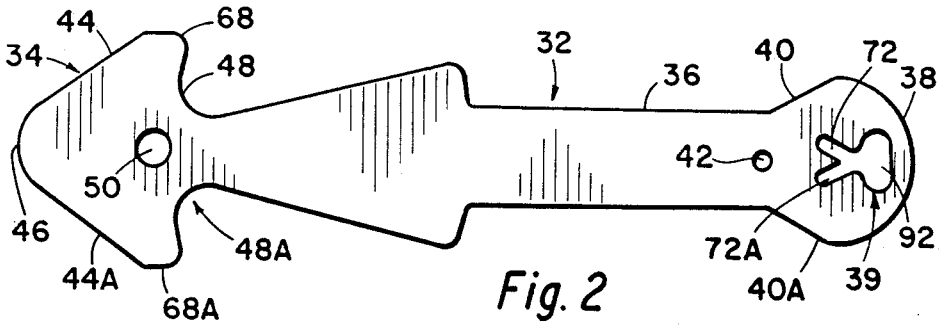
FIG. 2 is a full face view of the keeper.

Attention is now directed to FIG. 2 which shows the keeper 32 which is also symmetrically constructed. It is substantially flat and has a head 34, a tail section 36 and an enlarged release section 38 which has an upper surface 40 and a lower surface 40A. A pivot hole 42 is provided in tail extension 36 near the release section 38.

A padlock opening 39 is provided in release section 38. This opening has a base area 92 and an upper locking slot 72 and a lower locking slot 72A. Head 34 has an upper cam surface 44 and a lower cam surface 44A which are symmetrical and a rounded nose 46. The head is so designed as to form an upper receiving notch 48 and a lower symmetrical striker receiving notch 48A. The slope of cam surfaces 44 and 44A is typically about the same as that of cam surfaces 26A and 26. Head 34 additionally has a lock hole 50 which when the keeper is in a closed position is opened with either hole 28 or hole 28A.

Figure 3:
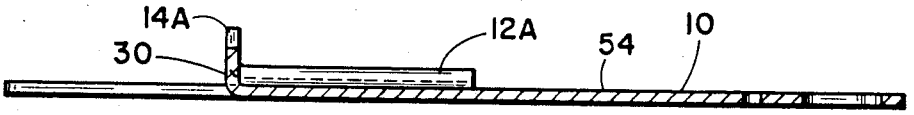
FIG. 3 is a view taken along the line 3—3 of FIG. 1.
Figure 6:
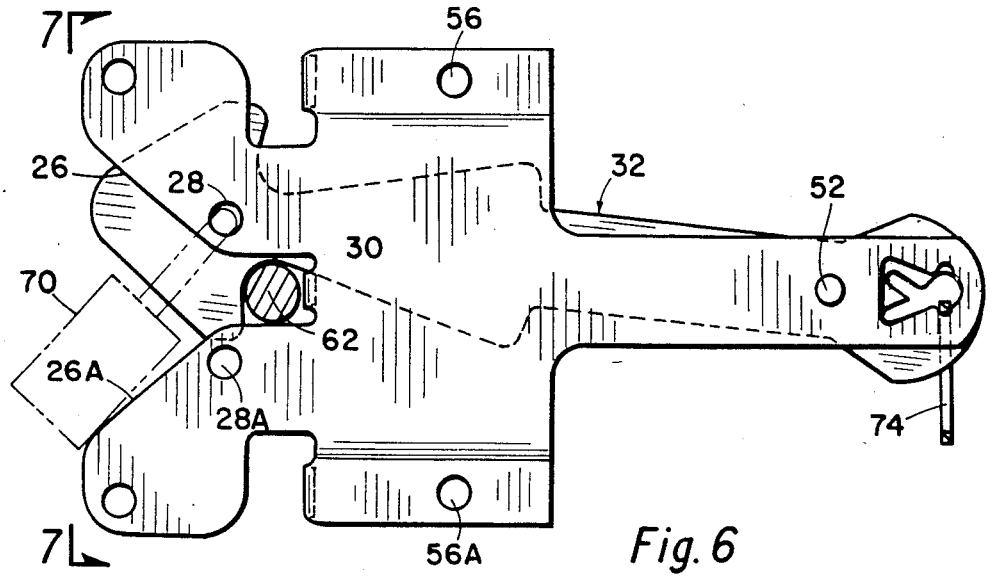
FIG. 6 is a view taken along the line 6—6 of FIG. 5.

As shown in FIG. 6 keeper 32 is pivotally attached to main frame 10 by pivot 52. This is the only pivot or bolted connection between the keeper and the main frame. As indicated in FIG. 3, spacer 12A extends above the face 54 of main frame 10 an amount slightly greater than the thickness of keeper 32.

Figure 5:
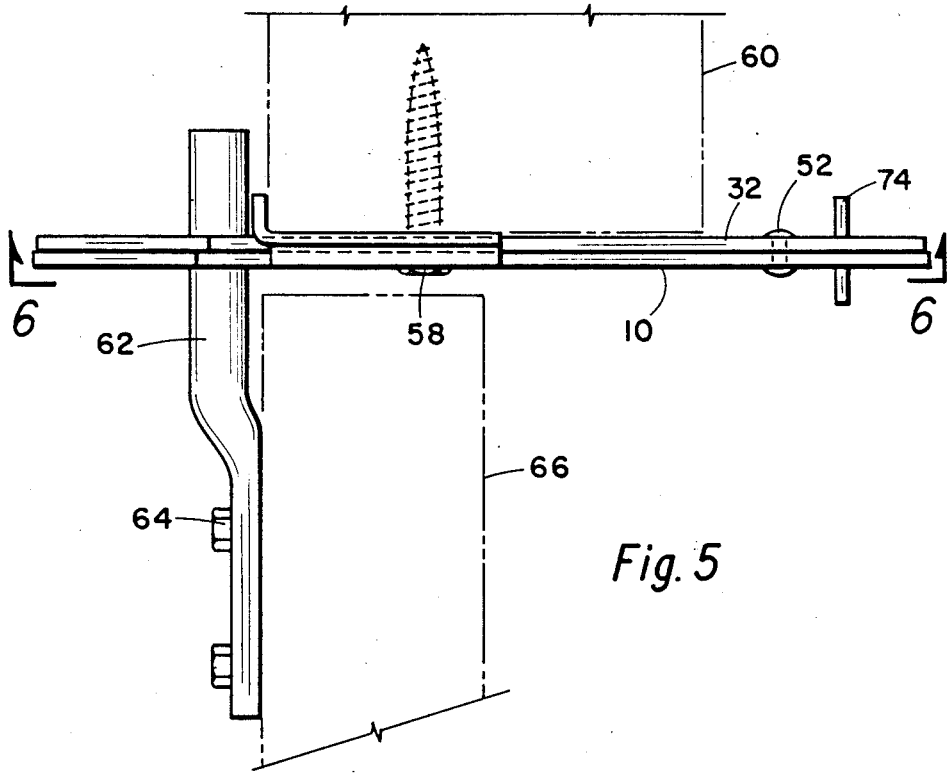
FIG. 5 is a plan view showing the latching mechanism attached to a post and the striker attached to a gate.
Figure 9:
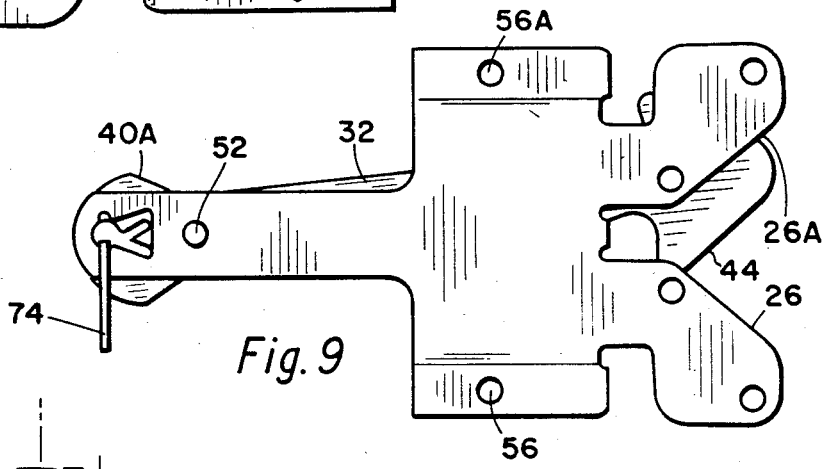
FIG. 9 is similar to FIG. 6 except it shows the latch after changeover from a left hand position to a right hand position.
Figure 7:
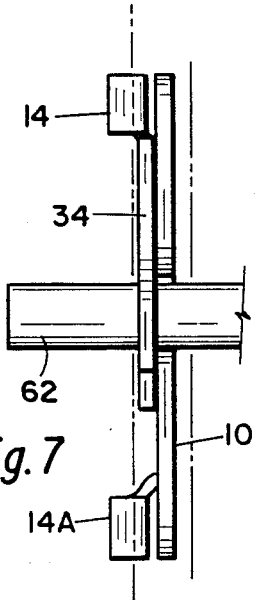
FIG. 7 is a view taken along the line 7—7 of FIG. 6.
Figure 10:
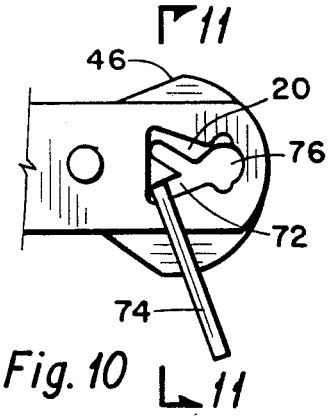
FIG. 10 is a fragmentary view of the end of the keeper of the main frame and the keeper showing the locking mechanism.
Figure 11:
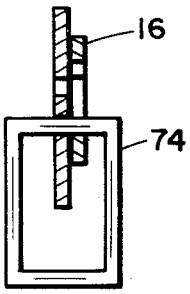
FIG. 11 is a view taken along the line 11—11 of FIG. 10.

The main frame 10 has an upper hole 56 and a lower symmetrical hole 56A in raised spacers 12 and 12A respectively. As shown in FIG. 5 keeper 32 is attached to main frame 10 by pivot 52 and is on the selected side of the retainer stub 30 so that it will be above the retainer stub when the latch is installed on a gate post. As shown in FIG. 5 a screw 58 is inserted through holes 56 and 56A of the main frame with the assembly positioned against the post 60 with the alignment stub 14A against the corner thereof as shown in FIG. 5. The other alignment stub 14 is also against the post so that the structure is properly aligned. A striker 62 is attached by screws 64 to gate 66. The structure 62 is positioned on the gate 66 so that as the gate swings shut it will be at the proper level to contact cam surface 44A of the keeper and the cam surface 26A of the main frame or if reversed as in FIG. 9 cam surface 44 and cam surface 26. The force of this contact will push the keeper upwardly about pivot 42 and striker 62 will enter into striker receiving notch 22 into the position shown in FIG. 6. When the striker 62 goes beyond the corner 68A of the keeper the keeper will drop down and the striker 62 will be locked in striker receiving notch 48A of the keeper and notch 22 of the main frame in the position shown in FIG. 6. If one wishes to padlock the gate it can be done from either the inside or the outside. As shown in FIG. 6 a padlock 70 extends through lock hole 50 of the keeper and padlock hole 28 of the main frame. In this position the striker 62 is held in a securely locked position. If desired it can be locked from the other end or the inside of the fence in which the locking slots 72 of release section 38 is aligned with the padlock hole 20 of the main frame. A padlock can be positioned through these holes or, alternatively, a slip lock ring 74 can be placed therein as shown in FIGS. 10 and 11. It is preferred that slip lock ring 74 has a substantially square cross section so that it can fit into downwardly sloping slot 72 and hold the keeper in the locked position. By moving slip lock ring 74 to the enlarged portion 76 the keeper can be moved a sufficient amount by pushing on surface 46 to lift head 44 up where the striker receiving lock 48A is above the striker 62 to the position shown in FIG. 8 which is really the release position. This release position can be obtained from the inside by pushing down on surface 40 of the keeper to obtain the position shown in FIG. 8. From the outside one can merely lift up on the cam surface 44A until the striker receiving notch 48A is in the position shown in FIG. 8.

This gate latch assembly is exceptionally easy to install. With the keeper pivotally attached to the main frame and in the proper position with respect to the keeper retaining stub 20 one merely has to push the alignment stubs 14 and 14A against the post 60 as indicated in FIG. 5. When this is at the proper elevation, screws 58 are installed through holes 56 and 56A. Striker 62 is then installed on gate 66 by use of screws 64 at an elevation or height such that the striker is at the same elevation as striker receiving opening 22. A handle may be attached over the striker 62. The latch described herein has no spring assist. Its operation is based on gravity eliminating the need for a spring that can become lost or become defective. These two parts of the latch, namely the keeper 32 and main frame 10 are fastened together by a single shop applied rivet thereby eliminating the need for removable fasteners that may become lost or need periodic tightening and service. In operation it is also noted that the latch is self-closing, that is, the keeper automatically catches the striker when the gate is swung to the closed position. Opening of the gate from the front is facilitated by pushing up on the keeper and back side disengagement is effected by pushing down on the end of the keeper. It is preferred that the latch be very heavy duty and that the main frame 10 and the keeper 32 is made of high quality steel and the typical striker is three-fourth inch diameter steel pipe. The particular design causes the latch mechanism to possess extensive capability to combat possible gate sag. This is accomplished in the typical latch structure by making the width of the V-grooves or cam surface 26A to be long enough so that it extends one inch or more below the bottom of the striker receiving opening 22. Then, if the gate sags this amount, the striker will still contact the striker cam 26A and will follow it into the opening 22. Thus, the gate can be closed even though there is considerable sag in the gate. However, this structure helps prevent gate sag. The supporting main frame 10, with the striker 62 resting on the bottom of notch 22, supports the weight of the gate pickets when in the closed position.

One cannot lift the striker bar out of the lock notch when the gate is closed by lifting the gate.

The present latch is provided with two different surfaces to support the weight of the gate on the latch main frame. The V-groove, namely entrance cam surface 26 and 26A at the front of the latch insures gate support for either right handed or left handed gates simply by turning the latch over.

When it is desired to open the gate all that is necessary to do is push down on either surface 40 of the end of the keeper inside the gate and fence or from the outside to lift up on the head 34. When the position shown in FIG. 8 the gate can be opened removing the striker for receiving opening 22.

As shown in FIG. 5 the keeper 32 is between the main frame 10 and the post 60. It is thus in a largely protected position.

Figure 4:
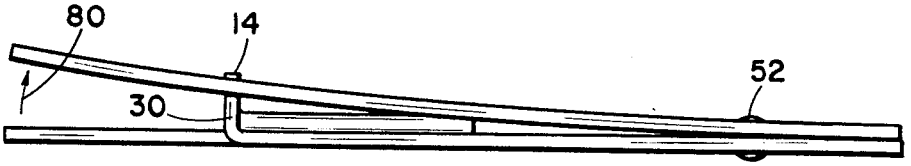
FIG. 4 is a plan view showing the changeover feature for converting the latch structure from a left hand to a right hand gate.
Figure 8:
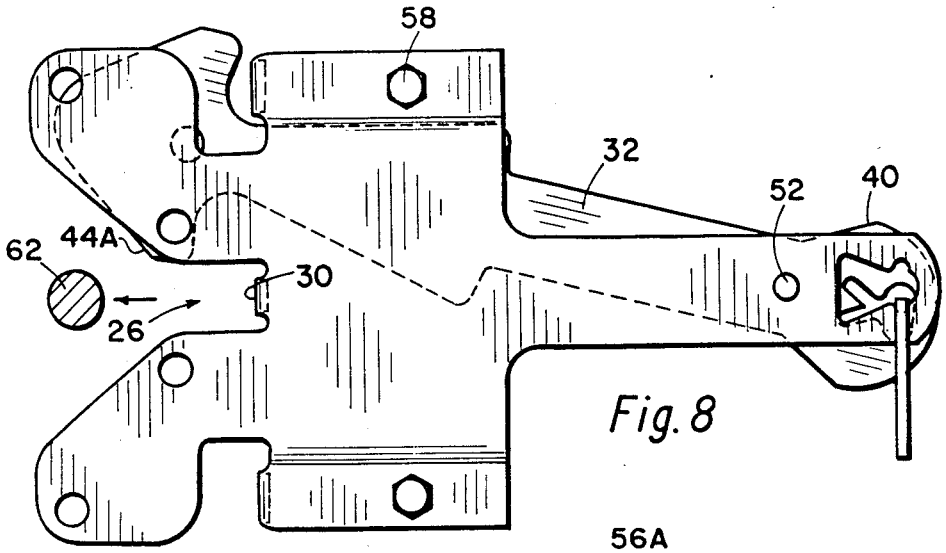
FIG. 8 is similar to FIG. 6 except it shows the keeper in the released position.

Another important feature of this latch structure is that it can be readily converted for use on a left hand gate without any disassembly or changing or removal of the internal working parts. As shown in FIGS. 6 and 8 the keeper 32 must be such that it is above or higher than retainer stub 30 when installed. This permits the locking motion of the keeper 32 to be caused by gravity. This latch structure can be used on either a left hand or right hand gate. One first determines which way the gate is installed so one will know whether the spacer 12 or 12A is up. Whichever side is up will need the keeper on the top side of the keeper retainer stub 30. The keeper can be changed from one side of keeper retaining stub 30 very easily. As shown in FIG. 4 the keeper is lifted at the outer end where it is sprung slightly and will slide over the keeper retaining stub 30 and when it passes over just to release the upward force indicated by the arrow 80 in FIG. 4 and the keeper will fall flat against the main frame. The spring effect of the keeper will keep it in the proper position. Further, when installed the keeper is in a protected position between the main frame 10 and the post 60. FIG. 9 shows the latch mechanism after its "change-over" from that shown in FIGS. 6 and 8.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What I claim is:

1. A gate latch structure for receiving a striker bar which comprises:

a longitudinal main frame having a striker receiving notch at a forward end with an inner end; two opposite cam surfaces flaring outwardly from said notch;

a retainer stub fixed to said main frame at said inner end of said notch;

a substantially flat keeper parallel with said main frame having a longitudinal axis and a V-shaped head forming an upper and lower striker receiving cam surfaces with upper and lower lock notches positioned near a forward end of said keeper;

a single pivot connecting said keeper to said main frame at a rearward end so that said keeper can pivot from a first position where one of said lock notches closes said striker receiving notch and a second position where the lock notch is clear of said striker receiving notch permitting a striker bar to enter the leave said notch.

2. A gate latch structure as defined in claim 1 including a first and second raised spacer section attached to and extending from said main frame and a first and second alignment stub extending from each said spacer and a hole in each said spacer said keeper positioned within said raised spacer section.

3. A gate latch structure as defined in claim 2 in which the keeper has a head with a lock hole therein and said main frame adjacent said notch has a lock hole so that when said keeper is in its closed position said lock holes align so that a padlock may be placed therein.

4. A gate latch structure for receiving a striker bar which comprises:

a main frame having a striker receiving notch with an inner end; two opposite cam surfaces flaring outwardly from said notch;

a retainer stub fixed to said main frame at said inner end of said notch;

a substantially flat keeper having a longitudinal axis and a head with two striker receiving lock notches positioned near one end of said keeper;

a single pivot connecting said keeper to said main frame so that said keeper can pivot from a first position where one of said lock notches closes said striker receiving notch and a second position where the lock notch is clear of said striker receiving notch permitting a striker bar to enter or leave said notch; and one end of said keeper opposite said striker receiving notches being provided with a locking cutout including a base hole with two sloping locking slots extending therefrom and in which the end of said main frame opposite the entrance cam surfaces is provided with a locking hole which when the keeper is in a closed position mates with the base hole of said keeper.

5. A gate latch structure as defined in claim 4 including a slip lock ring having a rectangular configuration and with a rectangular cross section and inserted through said base hole of said keeper and said padlock hole of said main frame.

6. A gate latch structure for receiving a striker bar which comprises:

a longitudinal main frame having at its forward end a strike receiving notch with outwardly and forardly flaring entrance cam surfaces;

a keeper retaining stub at the rearward end of said notch;

a pivot hole at the rearward end of said main frame, said main frame being symmetrical about a forward-rearward line drawn through the center of said pivot hole and said striker receiving notch;

a longitudinal keeper having an outwardly and rearwardly V-shaped head at its forward end and a pivot hole at its rearward end, said keeper being symmetrically constructed about a forward-rearward line passing through said pivot hole and the apex of said V-shaped head, said keeper further having upper and lower receiving notches at the rearward end of said V-shaped head; and a pivot means extending through said respective pivot holes of said main frame and said keeper.

7. A structure of claim 6 wherein said main frame includes first and second raised spacer sections and first and second alignment stubs creating a space for the pivotal movement of said keeper between said keeper retaining stub and one of said first and second alignment stubs.

8. A gate latch structure of claim 7 wherein said keeper has a lock hold in said head and wherein said main frame has an aligned corresponding hole when said keeper is in its closed position about said striker bar.

9. A gate latch structure as defined in claim 8 in which the rearward end of said keeper is provided with a locking cutout including a base hole with two sloping locking slots extending therefrom and in which the end of said main frame opposite the entrance cam surfaces is provided with a locking hole which when the keeper is in a closed position mates with the base hole of said keeper.

10. A gate latch structure as defined in claim 9 including a slip lock ring having a rectangular configuration and with a rectangular cross section and inserted through said base hole of said keeper and said padlock hole of said main frame.

* * * * *